United States Patent [19]

Wheeler

[11] Patent Number: 4,621,806

[45] Date of Patent: Nov. 11, 1986

[54] THERAPEUTIC APPARATUS

[75] Inventor: William K. Wheeler, Amherst, N.H.

[73] Assignee: W. K. Wheeler, Inc., Amherst, N.H.

[21] Appl. No.: 700,554

[22] Filed: Feb. 11, 1985

[51] Int. Cl.[4] ..... A63B 21/00

[52] U.S. Cl. ..... 272/93

[58] Field of Search ..... 272/93, 63, 64, 62, 272/109, 67, 68, 102

[56] References Cited

U.S. PATENT DOCUMENTS

| | | | |
|---|---|---|---|
| 1,573,362 | 2/1926 | Stovall | 272/93 |
| 1,982,934 | 12/1934 | Squire | 272/102 |
| 2,954,977 | 10/1960 | Durlacher | 272/63 |
| 3,472,509 | 10/1969 | Flynn | 272/62 |
| 4,351,525 | 9/1982 | Rozenblad | 272/93 |

FOREIGN PATENT DOCUMENTS

| | | | |
|---|---|---|---|
| 1112170 | 11/1955 | France | 272/68 |
| 377088 | 12/1939 | Italy | 272/67 |

*Primary Examiner*—Richard J. Apley
*Assistant Examiner*—S. R. Crow
*Attorney, Agent, or Firm*—Robert T. Gammons

[57] ABSTRACT

Apparatus comprising a pair of hand-supporting structures defining upwardly-facing rigid surfaces substantially coextensive in area and corresponding substantially in surface contour to the palmar surface of the hands supported by pedestals at a height from the floor such as to enable one to perform pushups between a pair of such supports from a substantially prone position.

6 Claims, 9 Drawing Figures

THERAPEUTIC APPARATUS

BACKGROUND OF THE INVENTION

Persons afflicted with arm, shoulder and neck ailments often find that performing pushups from a generally prone position in a mild form is beneficial. Such exercise, however, has the disadvantage that the pressure of the palmar surface of the hands against the flat surface of the floor tends to stretch the hands and fingers and this can be especially painful if the hands are arthritic. It is the purpose of this invention to provide hand-supporting devices which will enable one to perform pushups beneficial to the exercise of the arms, shoulders and neck muscles without discomfort to the hands and since the disability of such persons varies widely, to structure the devices according to the degree of disability. While the devices are designed especially for therapeutic purposes, they can also be used to advantage by persons unafflicted by any disability for the purpose of exercise.

SUMMARY OF THE INVENTION

As herein illustrated, the therapeutic apparatus of this invention comprises a pair of hand-supporting structures, each having an upwardly-facing rigid surface coextensive in area and corresponding substantially in surface contour to the palmar surface of the hand and a pedestal supporting the same in stable equilibrium at a height such as to enable one to support himself in a generally prone position between a pair of hand-supporting structures with his hands engaged with the upwardly-facing surfaces thereof for performing pushups therebetween. The outboard side of each structure has a depending flange about which the fingers of a hand engaged with the upwardly-facing surface of the structure can be curled to facilitate grasping the structure. The pedestal comprises a baseboard of generally rectangular configuration defining a flat surface for engagement with the floor and a vertically-positioned strut fixed at its lower end to the baseboard. The hand-supporting structure is fixed to the upper end of the strut. Desirably, the baseboard is recessed to receive the lower end of the strut and the downwardly-facing side of the hand-supporting structure is recessed to receive the upper end of the strut. A brace is provided at the outboard side of the strut and secured to both the strut and the baseboard. Desirably, the inboard side of the baseboard is tapered.

The structure can be made in a range of heights to provide for persons according to their physical capacity.

The invention will now be described in greater detail with reference to the accompanying drawings, wherein.

Figure 1:
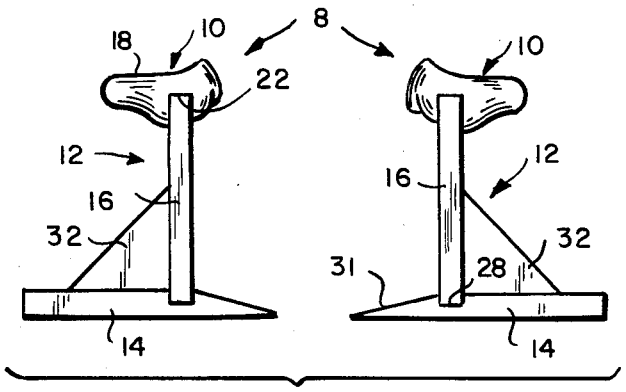
FIG. 1 is an elevation of a pair of hand-supporting structures disposed in spaced relation for use.
Figure 2:
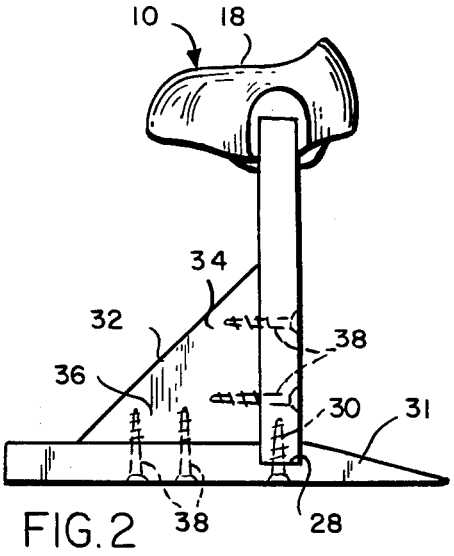
FIG. 2 is an enlarged elevation of the posterior side of a structure.

Referring to the drawings, FIG. 1, there is shown a pair of hand-supporting devices 8—8 each comprising a hand-supporting structure 10 supported in stable equilibrium above the floor by a pedestal 12 comprising a baseboard 14 and a strut 16. A person using a pair of these devices 8—8 can perform pushups by positioning himself between the devices with his hands resting on the hand-supporting structures 10—10 and raising and lowering himself relative to the floor and by performing pushups in this manner, strengthen his arms, shoulders and neck muscles. Pushups can be performed between the structures facing downwardly or upwardly.

In order to alleviate any discomfort to the hands from the pressure of pushups as would be caused by placing the hands flat on the floor or other flat surface, hand-supporting devices of the kind disclosed in U.S. Pat. No. 3,517,678 are employed, wherein the upper surface 18 of each hand-supporting structure 10 is substantially coextensive with the palmar surface of the hand and corresponds substantially in surface contour with the palmar surface of the hand as specifically described in the aforesaid patent.

While a solid hand-supporting structure may be employed as shown in the aforesaid patent, desirably, the hand-supporting structures employed herein are recessed at their undersides, FIGS. 1A and 1B, so as to provide a peripheral flange 20 about the lower side about which the fingers can be curled to enable firmly grasping the structure. The peripheral flange 20 not only provides a grasp, but a reinforcement.

As herein illustrated, each hand-supporting structure 10 is mounted to the upper end of a strut 16 and, to this end, the posterior and anterior sides of the flange 20 are recessed at 22—22 to receive the upper end of the strut. Desirably, the recesses 22—22 are dimensioned so that the hand-supporting structure can be frictionally engaged at the upper end of the strut without having to use fastening elements, although it is to be understood that fastening elements can be used and, if used, they are inserted through the structure into the upper edge of the strut.

Figure 4A:
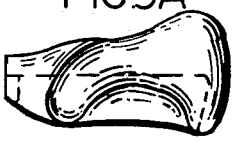
FIG. 4A is a side elevation of the hand support of FIG. 4 removed from the strut.
Figure 4:
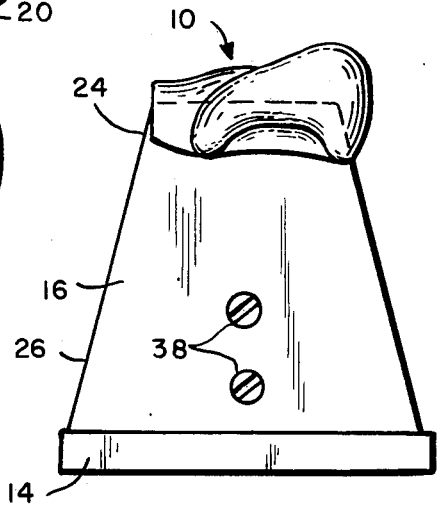
FIG. 4 is an elevation of the inboard side of the structure.
Figure 5:
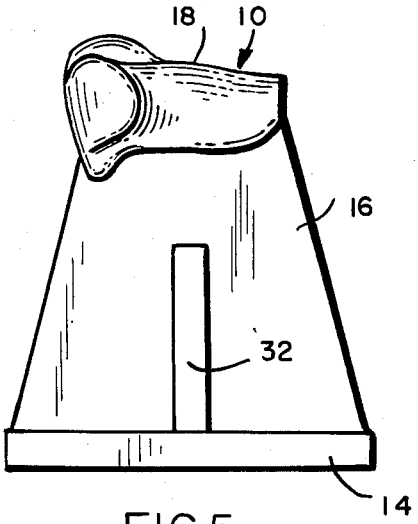
FIG. 5 is an elevation of the outboard side of the structure.
Figure 6:
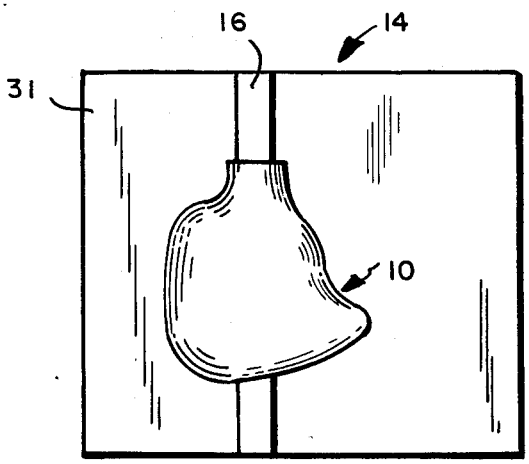
FIG. 6 is a plan view of the structure.

As shown in FIG. 4, the strut 16 is truncated, the upper end 24 corresponding substantially in width to the posterior-to-anterior dimensions of the hand-supporting structure 10 and the lower end 26 corresponding substantially in width to the width of the baseboard 14. Desirably, the lower end of the strut 26 is seated in a recess 28 formed in the baseboard and fastened therein by screws 30 inserted through the baseboard into the lower end of the strut.

The baseboard 14 at its outboard side is of uniform thickness and at its inboard side tapers as at 31.

In order to hold the strut 16 rigidly perpendicular, a brace 32 is positioned on the baseboard at the outboard side of the strut with one side 34 engaged with the strut and the other side 36 engaged with the baseboard. Desirably, screws 38 are inserted through the strut and through the baseboard into the brace.

While the structure described is especially designed for persons afflicted with arm, shoulder and neck ailments, it is equally useful as an exercising device by unafflicted persons for it has the advantage pointed out above that the configured hand support enables performing pushups without subjecting the hands to abnormal strains.

Figure 7:
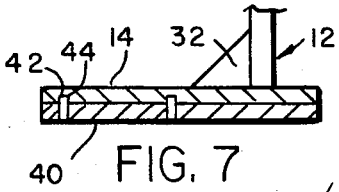
FIG. 7 is a fragmentary elevation of a hand support provided with an adapter to increase its height.
Figure 3A:
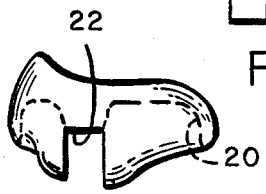
FIG. 3A is an end elevation of the hand support shown in FIG. 3 removed from the strut.
Figure 3:
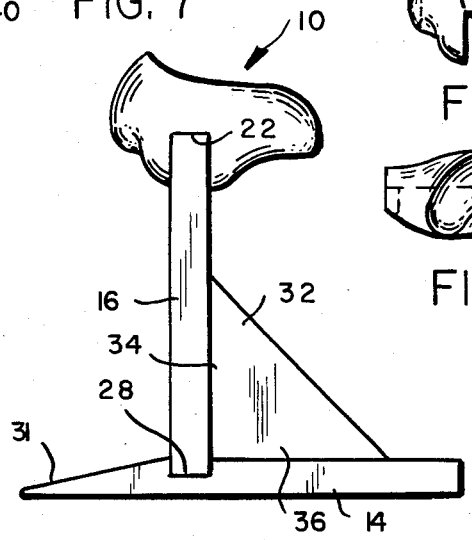

Desirably, to accommodate the weak and the strong, the devices are made in a range of heights, for example, 3, 6 and 9 inches, and by using an adapter of $1\frac{1}{2}$ inch thickness, heights of $4\frac{1}{2}$, $7\frac{1}{2}$ and $11\frac{1}{2}$. The adapter, FIG. 7, comprises a flat panel corresponding in area to the baseboard 14, $1\frac{1}{2}$ inches thick. Desirably, for this purpose, the baseboard 14 contains at its underside holes 42 for receiving dowels 44 fixed in the upper surface of the panel 40.

The structure as described may be comprised of plastic, wood or metal, or a combination of these materials.

As previously explained, the hand-supporting devices 8—8 have hand-supporting surfaces 18 contoured like the hand supports shown in the aforesaid patent and, hence, embody all of the beneficial characteristics disclosed therein.

It should be understood that the present disclosure is for the purpose of illustration only and includes all modifications or improvements which fall within the scope of the appended claims.

What is claimed is:

1. Apparatus comprising a pair of hand-supporting structures, each having upwardly-facing rigid surfaces corresponding in surface contour to substantially the palmar surface of the hand, each structure embodying an outboard side about which the fingers can be curled and means supporting the hand-supporting structure in stable equilibrium at a height such as to enable one to support himself in a generally prone position between a pair of said hand-supporting surfaces with his hands engaged with the upwardly-facing surface thereof and with his fingers curled about the outboard sides to perform pushups therebetween, said means comprising a rectangular baseboard containing in its top side a groove parallel to two of its sides, said baseboard at one side of the groove being wider than the other side and said baseboard at the other side tapering from a thickness adjacent the groove corresponding to the thickness of the baseboard at said one side to an aborted feather edge, a support structure of generally trapezoidal configuration disposed with its lower edge in the groove in the baseboard and its upper edge disposed in a groove at the underside of the hand supporting structure disposed longitudinally of the hand supporting structure, said hand supporting structure being disposed with its outboard side overlying the said one side and a triangular brace disposed at said one side of said support structure with one right side fixed to said support structure and the other right side fixed to said baseboard.

2. Apparatus according to claim 1 wherein the outboard side of each hand-supporting structure has a depending flange about which the fingers of a hand engaged with the upwardly-facing surface can be curled to facilitate grasping the structure.

3. Apparatus according to claim 1 wherein the hand-supporting structure is comprised of molded plastic.

4. Apparatus according to claim 1 wherein the hand-supporting structure is comprised of metal.

5. Apparatus according to claim 1 wherein the hand support is comprised of wood.

6. Apparatus according to claim 1 wherein the devices are available in 3, 6 and 9 inch heights and an adapter block of $1\frac{1}{2}$ inch thickness is provided for use in conjunction therewith to provide for heights of $4\frac{1}{2}$, $7\frac{1}{2}$ and $11\frac{1}{2}$.

* * * * *